United States Patent [19]

Thrush

[11] 3,932,113

[45] Jan. 13, 1976

[54] CANDLE HOLDER UNIT AND THE LIKE

[75] Inventor: James Lloyd Thrush, Lancaster, Ohio

[73] Assignee: Anchor Hocking Corporation, Lancaster, Ohio

[22] Filed: Feb. 19, 1974

[21] Appl. No.: 443,365

[52] U.S. Cl. ..... 431/297; 431/289; 215/10; 220/4 E

[51] Int. Cl.[2] ..... F23D 3/16

[58] Field of Search ..... 431/289, 295, 297, 292; D48/2; 215/10, 99.5; 220/4 B, 4 E

[56] References Cited

UNITED STATES PATENTS

| | | | |
|---|---|---|---|
| 67,391 | 7/1867 | Wilcox | 215/10 |
| 2,347,658 | 5/1944 | Bourne | 215/99.5 |
| 2,659,222 | 11/1953 | Meier | 220/4 B |
| 3,547,569 | 12/1970 | Fenton et al. | 431/295 |
| 3,743,473 | 7/1973 | Von Suskil | 431/289 |

*Primary Examiner*—Carroll B. Dority, Jr.
*Attorney, Agent, or Firm*—Holland, Armstrong, Wilkie & Previto

[57] ABSTRACT

A candle holder unit whereby a number of candles of different sizes may be accommodated and in which similar units can be mounted together to assume different heights and configurations.

4 Claims, 7 Drawing Figures

Fig. 1.
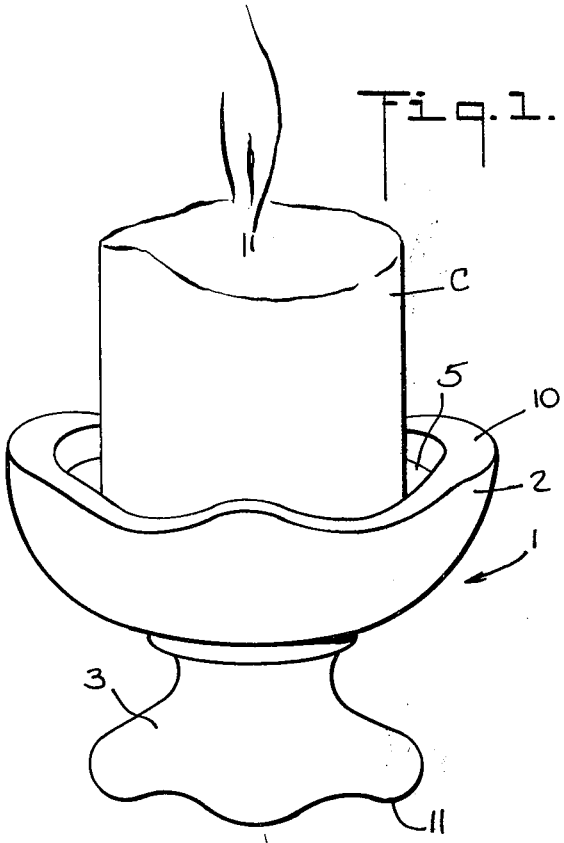
Fig. 2.
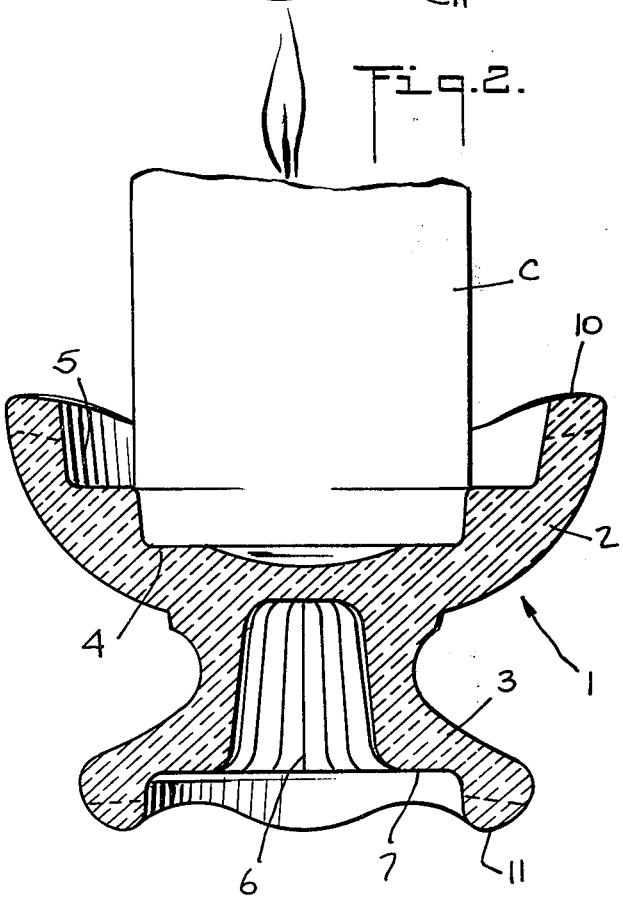
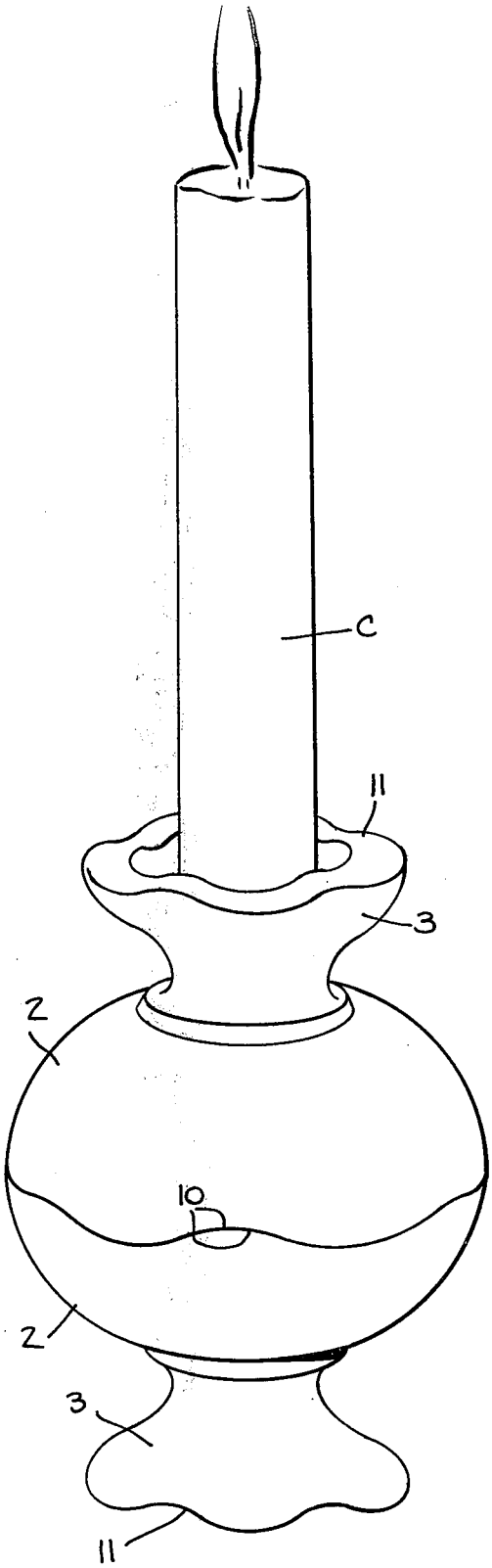
Fig. 3.

CANDLE HOLDER UNIT AND THE LIKE

The present invention relates to an improved candelabra and more particularly to an improved candelabrum unit which may be used together in order to assume different heights and shapes and to accommodate candles of different sizes.

An object of the present invention is the provision of an improved candelabra unit which may be used alone or with a plurality of other similar units to assume different heights and shapes.

Another object of the present invention is an improved candelabra unit which is adapted to be stacked on top of each other to assume different heights and shapes.

Another object of the present invention is a provision of an improved candelabra unit which may be stacked with other similar units in different manners in order to assume different shapes.

Another object of the present invention is a provision of an improved candelabra unit which may also be used as a candy dish.

Other and further objects of the invention will be obvious upon an understanding of the illustrative embodiment about to be described or will be indicated in the appended claims, and various advantages not referred to herein will occur to one skilled in the art upon employment of the invention in practice.

A preferred embodiment of the invention has been chosen for purposes of illustration and description and is shown in the accompanying drawings, forming a part of the specification, wherein:

FIG. 1 is a perspective view showing one of the candelabra units in use;

FIG. 2 is a sectional view of the unit shown in FIG. 1;

FIG. 3 is a perspective view showing one manner in which a pair of candelabra units can be combined together;

Figure 4:
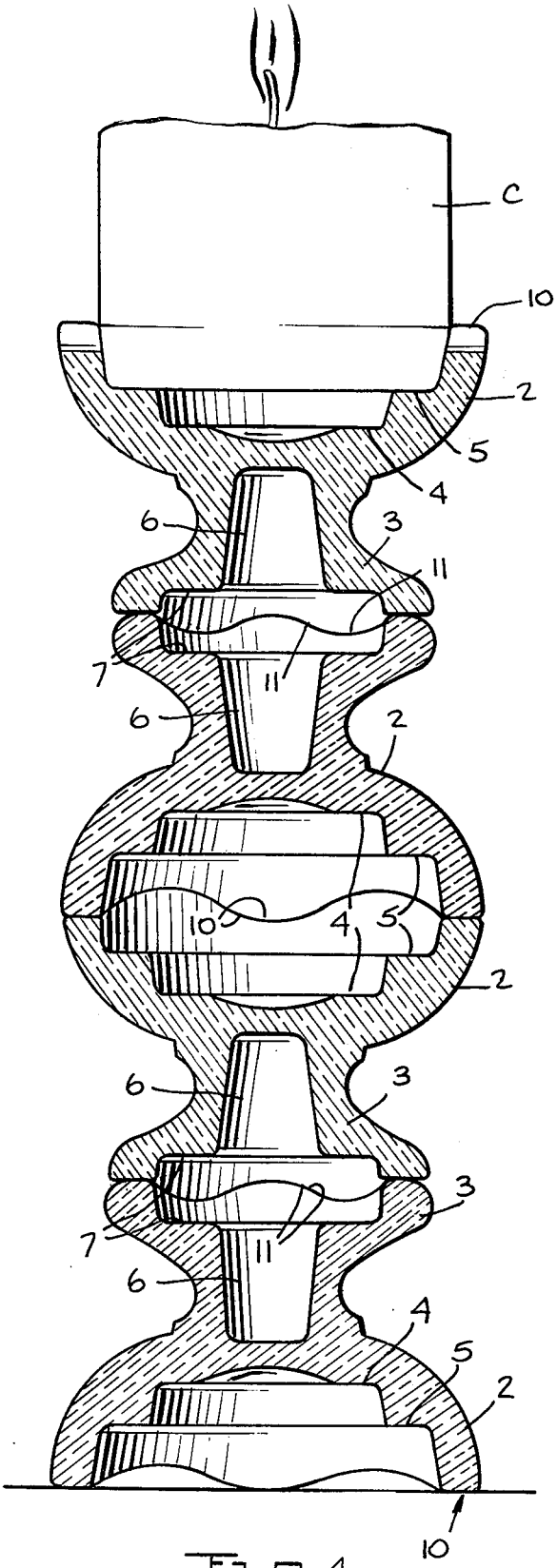
FIG. 4 is a sectional view showing another manner in which the candelabra units can be combined together.

Referring more particularly to the drawings, it will be seen that the candelabra unit 1 comprises a bowl-shaped upper body portion 2 with a foot portion 3 extending downwardly from the body portion 2. The bowl-shaped body portion 2 is hollow and has two candle-supporting ledges 4 and 5 at different levels so that each ledge 4 or 5 is adapted to support a candle of different size. If the ledge 5 is not being used to support a candle, it serves as a drip pan to catch dripping wax.

The foot portion 3 is also hollow and comprises a well 6 to accommodate a small candle and is also provided with a ledge 7 at a different level to either accommodate larger candles or to act as a drip pan, as the case may be.

The ledges 10 and 11 of the bowl and foot portions 2 and 3, respectively, are formed in an undulating shape comprising alternating low areas and high areas. The undulating edge 10 of the bowl portion 2 is adapted to match the undulating edge 10 of the bowl portions of other units with the high areas of one fitting into the low areas of the other. Hence, a plurality of units can rest and mesh with each other in bowl-to-bowl manner to form a solitary unit, for example, as shown in FIG. 3.

Likewise, the undulating edge 11 of the foot portion 3, is adapted to match with the high and low foot portions of the foot portions 3 of other units so that they can mesh and rest with each other in foot-to-foot fashion as shown in FIG. 4.

While the drawings show the edges 10 and 11 to be comprised of smooth undulating curves, it will be understood that the high and low areas of the edges 10 and 11 may be differently shaped, such as toothed, as long as the edges are able to mesh and interlock with each other.

Figure 5:
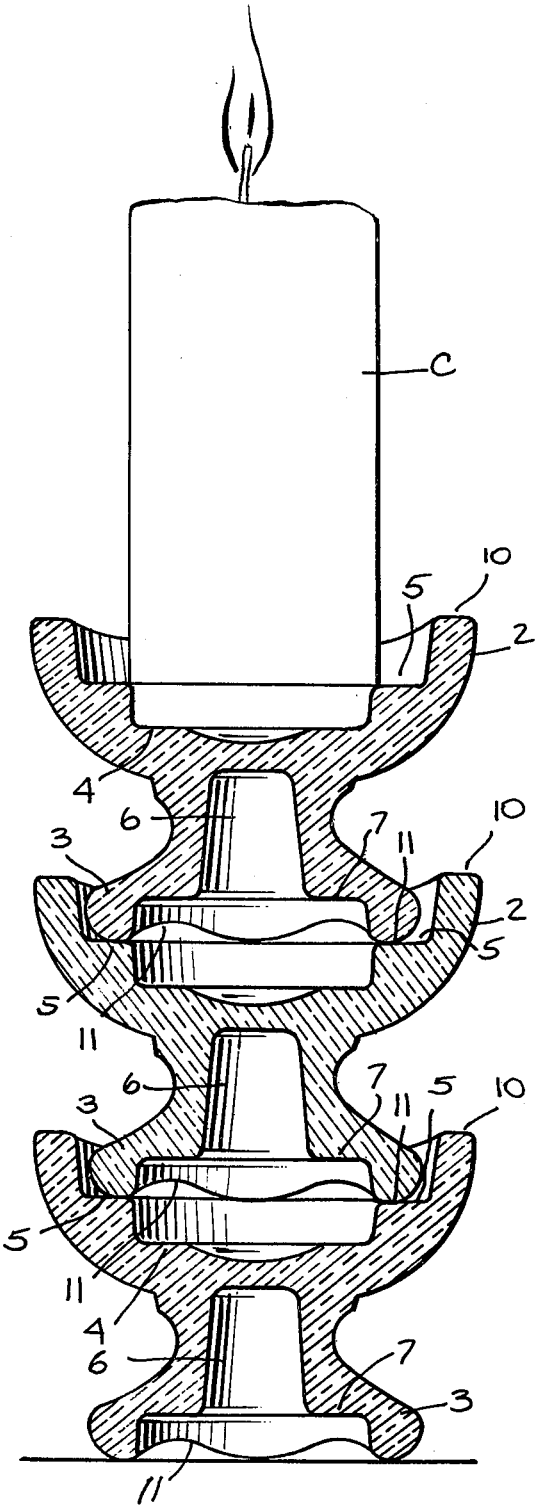
FIG. 5 is a sectional view showing another manner in which the units can be combined together.
Figure 6:
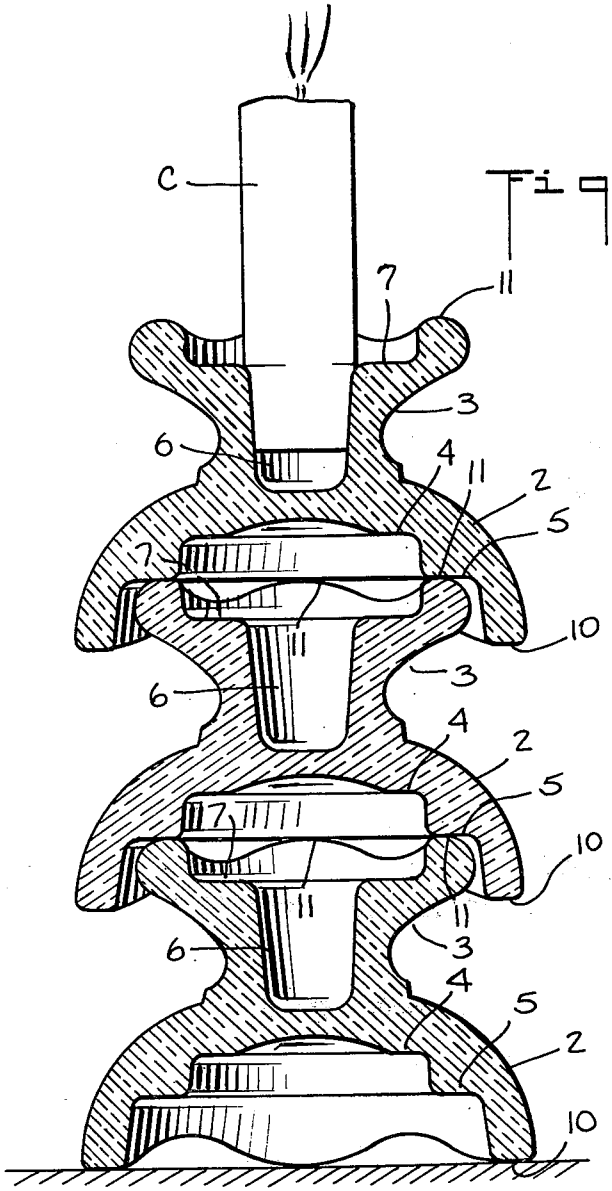
FIG. 6 is a perspective view showing still another manner of combining the units.

In addition and preferably, ledge 5 within the bowl portion 1 is wide enough to accommodate the edge 11 of the foot 3 of any unit so one is able to rest on the other to permit the two units to nest within each other as shown in FIGS. 5 and 6.

It will thus be seen that each unit can be used by itself, as shown in FIGS. 1 and 2, with candles of different sizes mounted within the bowl portion 2 or within the foot portion 3 of each unit, as may be desired. It will be noticed that candles of different sizes can be used depending on which ledge is used to hold the candle or on which the candle may rest. Furthermore, each unit can be used with the foot portion 3 down or can be inverted and used with the bowl portion 2 down.

Figure 7:
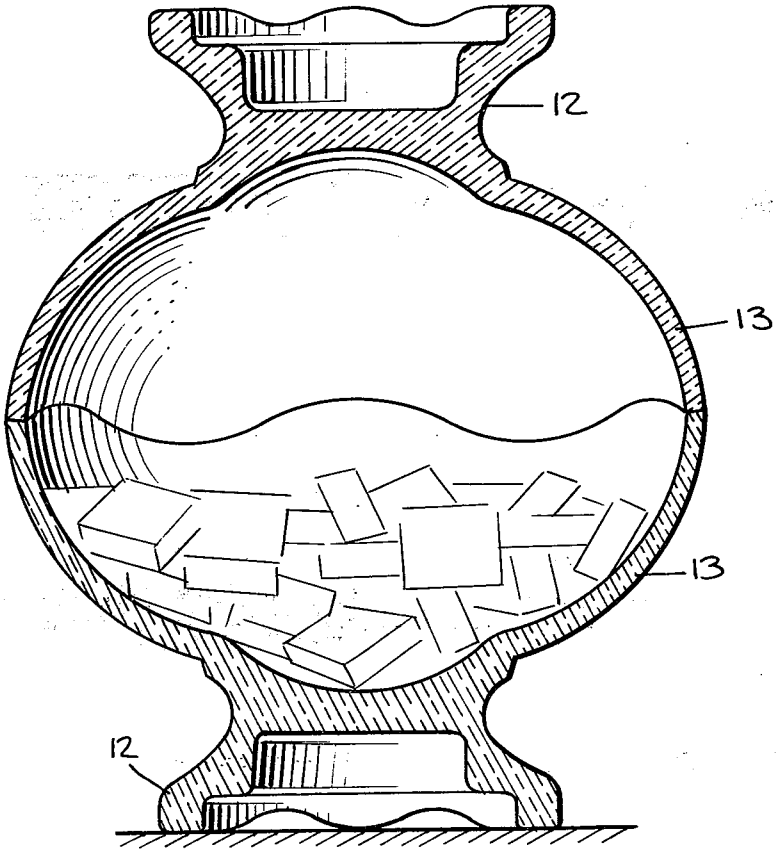
FIG. 7 is still another manner combining two units to act as a candy dish.

As shown in FIG. 7, the bowl portions 13 of the two units can be made to mate with each other to form a container for articles, such as candy or the like. In the particular situations shown in FIG. 7, the interior of the bowl portion is shown being slightly different (in that it does not have a candle holding ledges) and the interior of the foot portion is shown as not having a deep candle main well. However, it is within the province of the invention that the construction of the units shown in FIG. 7 can be identical with the units shown in FIG. 3 when used without departing from the spirit of the invention.

It will thus be seen that the present invention provides an improved candelabra units which may be used singly or in a plurality to assume different shapes and are adapted to be stacked with relationship to each other to assume different heights; and which may also be used together to act as a candy dish.

As many and varied modifications of the subject matter of this invention will become apparent to those skilled in the art from the detailed description given hereinabove, it will be understood that the present invention is limited only as provided in the claims appended hereto.

Having thus described my invention, I claim:

1. A bowl shaped unit comprising a bowl portion and an annular foot portion, said portions each having socket means for receiving an article and a corrugated edge, the edges of each of said portions comprising a corrugated surface which is adapted to mesh with a corrugated edge of a similar unit to permit the units to stack relative to each other and to prevent movement of the units relative to each other, said bowl portion having an interior ledge and said foot portion being of a size so as it may seat on the ledge of a similar unit.

2. A bowl shaped unit as claimed in claim 1 wherein said corrugated edge is an undulating surface.

3. A bowl shaped unit as claimed in claim 1 wherein the ledge acts as a dripping pan.

4. A bowl shaped unit as claimed in claim 1 wherein the foot portion has a ledge surrounding the socket to act as a drip pan.

* * * * *